United States Patent [19]

Hetzel, Jr.

[11] Patent Number: 4,793,005

[45] Date of Patent: Dec. 27, 1988

[54] SPORTS GLOVE

[75] Inventor: John M. Hetzel, Jr., Dayton, Ohio

[73] Assignee: Powr-Lok, Inc., Dayton

[21] Appl. No.: 78,620

[22] Filed: Jul. 28, 1987

[51] Int. Cl.[4] ..... A41D 19/00

[52] U.S. Cl. ..... 2/161 A

[58] Field of Search ..... 2/161 A, 159, 161 R, 2/160, 158, 169, DIG. 6

[56] References Cited

U.S. PATENT DOCUMENTS

| | | | |
|---|---|---|---|
| 461,744 | 10/1891 | Fanshawe | 2/160 |
| 1,681,389 | 8/1928 | Blake | 2/161 A |
| 2,877,465 | 8/1957 | Stroud | 2/20 |
| 3,105,972 | 10/1963 | Christopher | 2/161 A |
| 3,348,238 | 10/1967 | Hydock | 2/161 A |
| 3,402,984 | 9/1968 | Zazzara | 401/8 |
| 3,408,657 | 11/1968 | Gallagher | 2/159 |
| 3,547,112 | 12/1970 | Courtney | 128/77 |
| 3,559,212 | 2/1971 | Skovron | 2/161 A |
| 3,918,097 | 11/1975 | Mlodoch | 2/161 A |
| 4,000,903 | 1/1977 | Swanson | 273/166 |
| 4,057,255 | 11/1977 | Bishop | 2/161 A X |
| 4,400,831 | 8/1983 | Rietz | 2/161 A |
| 4,414,692 | 11/1983 | Dzierson et al. | 2/160 |
| 4,447,912 | 5/1984 | Morrow | 2/159 |
| 4,546,495 | 10/1985 | Castillo | 2/161 A |
| 4,720,279 | 1/1988 | Fritschen et al. | 2/161 A X |

*Primary Examiner*—David Werner

*Attorney, Agent, or Firm*—Smith & Schnacke

[57] ABSTRACT

A sports glove which includes a glove body, a plurality of open-ended stub fingers, a palm portion made of a flexible material, a flexible strap attached at a fixed end thereof to the palm portion and having a free end fitted with loop material, and a patch of hook material attached to the stub fingers. The strap is looped about a sports implement to be grasped and the free end of the strap is attached to the glove body by the connection formed between the patches of hook and loop material. In use, the tensile force exerted by the implement on the hand of the user bears against the portion of the free end overlapping the hook material to form a secure attachment, so that a portion of the force is borne by the strap and glove palm. The hook and loop connection can be released quickly by the wearer of the glove and involves merely the straightening of the wearer's fingers.

9 Claims, 2 Drawing Sheets

SPORTS GLOVE

BACKGROUND OF THE INVENTION

The present invention relates to sports gloves and, more particularly, gloves for facilitating the grasping of sports equipment. p In many sports activities, it is desirable for the participants to utilize specially designed gloves which facilitates the user's grasping an instrument which is an integral part of the sport. For example, Stroud U.S. Pat. No. 2,877,465 discloses a golf glove having a palm portion fitted with a hook made from a flat piece of steel. The hook is arranged on the palm so that it engages the handle of a golf club at a preferred angle relative to the glove, so that the club shaft is at the correct angle to the user's hand. Swanson U.S. Pat. No. 4,000,903 discloses a golf glove having a protruding rib formed across the palm portion and angled such that it lies against the handle of a golf club to be grasped. The rib is oriented so that the golf club handle is held at the proper angle relative to the glove and user's hand.

Rietz U.S. Pat. No. 4,400,831 discloses a water skiing glove having a strap of material attached to the palm of the glove and shaped to extend from a point rearwardly of the wrist opening, longitudinally of the palm, and terminate at the outer joints of the three middle fingers of the glove. The strap is stitched to the glove about its entire periphery, save for the portion protruding rearwardly of the wrist opening.

The strap includes a transverse, protruding rib and the end adjacent to the wrist opening also includes a wrist strap. The wrist strap is fastened to the main strap by stitching and has a free end fitted with a patch of hook material that engages a complementary patch of loop material attached to the main strap. The glove facilitate the grasping of a water ski tow bar in that the rib bears against the tow bar and thus transfers a portion of the tensile forces exerted by the tow bar to the glove and wrist strap, thereby reducing the gripping force required to grasp the tow bar.

Gloves are also used in the sport of weight lifting, and Castillo U.S. Pat. No. 4,546,495 discloses a glove which facilitates performing weight lifting presses. This glove includes a plurality of open-ended stub fingers and a palm portion having a tapered wedge extending from the heel of the hand inwardly toward the inside of the palm. The wedge purportedly allows the hand to be aligned relatively straight with respect to the ulna and radius when pressing.

However, such gloves do not aid the participant in performing a dead lift, in which a barbell is grasped with both hands and lifted from the floor while the arms of the participant are kept straight. Since a dead lift usually involves the greatest weight handled by a particular weight lifter for any lift requiring the weight lifter's hands to bear the entire load, quite often the upper limit of weight to be dead lifted is determined by the inherent strength of the weight lifter's grip, rather than the back and leg muscles, which are the muscles used to raise the weight from the floor.

Accordingly, there is a need for a sports glove which bears some of the weight lifted by a participant in a dead lift, thereby transferring a portion of the downward force of a barbell from the fingers of a participant to the palm, wrists, and arms. There is also a need for a sports glove which is capable of transferring the tensile force exerted by other types of weight lifts, as well as other sports implements, from the hand to the wrist of the user.

SUMMARY OF THE INVENTION

The present invention is a sports glove which is specially designed to aid the wearer in grasping a sports implement and sustaining the tensile loads exerted by that implement on the hands of the user. The glove includes a glove body shaped to slip over a human hand, a plurality of open-ended stub fingers, and a palm portion made of a flexible material such as leather. A flexible strap is stitched at one end to the palm portion and its opposite, free end is fitted with a patch of loop material. Patches of hook material are attached to the center stub fingers.

In use, the wearer inserts his hands into gloves of the present invention and loops the strap about the sports implement to be grasped so that the free end curls beneath the implement and the patch of loop material on the free end overlaps the patches of hook material on the stub fingers. This occurs when the wearer curls his fingers about the implement and urges it into the center of the palm portions of the gloves.

Although the glove can be used in such sports as windsurfing, water skiing and hang gliding, or wherever a wearer must exert a tight, prolonged grip on an object having a bar, rung or handle, its application is most readily apparent in weight lifting.

When the weight bar is lifted, pulled or otherwise displaced by the user, the overlapping portion of the strap and stub fingers is positioned so that the tensile force of the bar urges the free end against the fingers to prevent slippage of the strap end from beneath the bar. The force exerted by the bar is thereby borne partially by the strap, which transfers the weight to the palm portion and the glove itself. This removes some of the weight force from the fingers of the wearer.

In a preferred embodiment, a wrist strap is attached to the glove adjacent to its wrist opening so that the weight force borne by the glove is transferred to the wrist of the user, further relieving the hands from the force of the weight. Also in the preferred embodiment, a second patch of hook material is attached to the palm of the glove, but is located between the fixed end of the strap and the wrist opening. This allows the strap to be folded back and out of the way when not in use.

Although the preferred embodiment calls for patches of hook and loop material to be utilized to perform a releasable attachment between the free end of the strap and the glove, it is within the scope of the invention to provide alternate forms of material which create a non-slipping, friction fit. For example, the patches may be made of a rubber or foam.

In any event, one of the advantages of the invention is that the connection between the free end of the strap and the glove can be released instantly when the wearer relaxes his grip on the bar. The rotation of the wearer's fingers outwardly away from directly beneath the bar moves the overlapping portion of the strap and palm away from a position directly beneath the bar so that the weight force of the bar is no longer directed against the overlapping portion. This allows the weight of the bar to pull the strap away from the glove palm, thereby disengaging the patches of hook and loop material.

Accordingly, it is an object of the present invention to provide a sports glove which is specially designed to facilitate grasping and retaining a sports implement; a sports glove in which the tensile force exerted by a sports implement is transferred from the fingers of a user to the hand and wrist of the user; a sports glove in which the glove can be positively attached to the sports implement, but quickly released as the wearer releases his grip; and a sports glove which facilitates the grasping of sports implements but is sufficiently flexible to allow the wearer to maintain a "feel" for the implement.

Other objects and advantages of the present invention will be apparent from the following description, the accompanying drawings, and the appended claims.

DETAILED DESCRIPTION OF THE PREFERRED EMBODIMENTS

Figure 1:
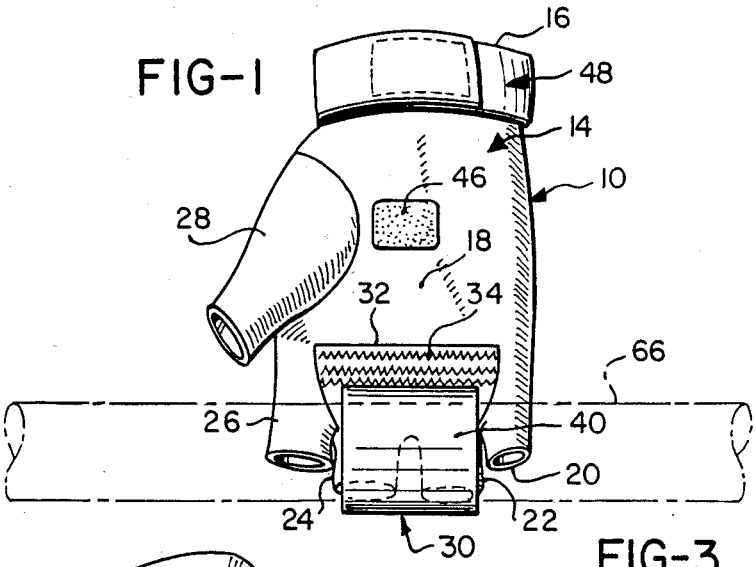
FIG. 1 is a plan view of a right hand sports glove of the present invention, shown engaging a barbell bar which is in phantom.
Figure 2:
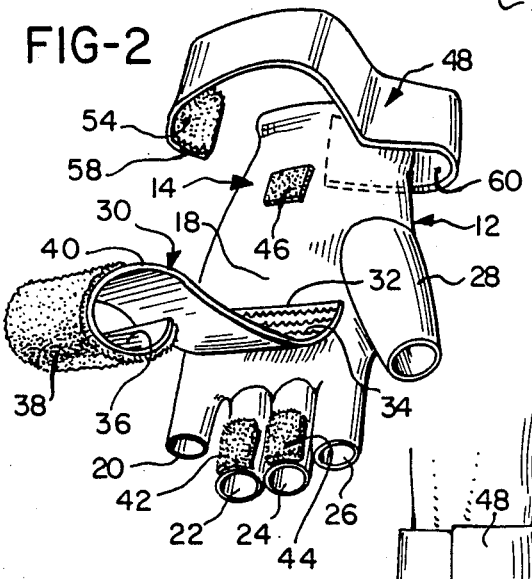
FIG. 2 is a perspective view of a left hand sports glove of the present invention, showing the wrists and palm straps loosened.
Figure 3:
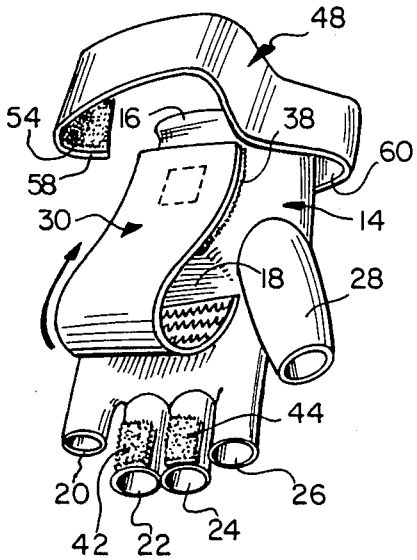
FIG. 3 is a perspective view of the glove of FIG. 2 in which the palm strap is attached to the palm at the wrist.

FIG. 1 shows a right hand glove 10, and FIGS. 2 and 3 show a left hand glove 12 of the sports glove of the preferred embodiment. The gloves 10, 12 each include a body 14 made of leather having a wrist opening 16 and a palm portion 18. The gloves 10, 12 are of identical construction, but are adapted to be worn on the right and left hands, respectively. The gloves 10, 12 each include four open-ended stub fingers 20–26 and an open-ended stub thumb 28.

A leather palm strap 30 includes a flared, fixed end 32 which is attached to the palm portion 18 of the body 14 by a plurality of rows of stitches 34, and a free end 36. The free end 36 includes a patch 38 of loop material secured by stitching (not shown) to its outer surface 40.

Patches of hook material 42, 44 are attached to the inside surfaces of the middle two stub fingers 22, 24 of each glove 10, 12 (best shown for the left hand glove 12 in FIGS. 2 and 3). A third patch 46 of hook material is attached to the heel of the palm portion 18 adjacent to the wrist opening 16 of each glove.

The gloves 10, 12 also include an integral leather wrist strap 48, attached at a fixed end 50 by stitches 52 to the back of the hand adjacent to the wrist opening 16 (seeFIG. 6). A patch of loop material 54 is attached to the free end 56 of the strap 48 at its inside surface 60 by stitches 62. A patch 64 of hook material is attached to the outside surface 62 of the strap 48 adjacent to the fixed end 50 by an adhesive. The strap 48 is sized such that the patch 54 of loop material overlays the patch 64 of the hook material when the strap is wrapped about the wrist opening of the glove.

Figure 4:
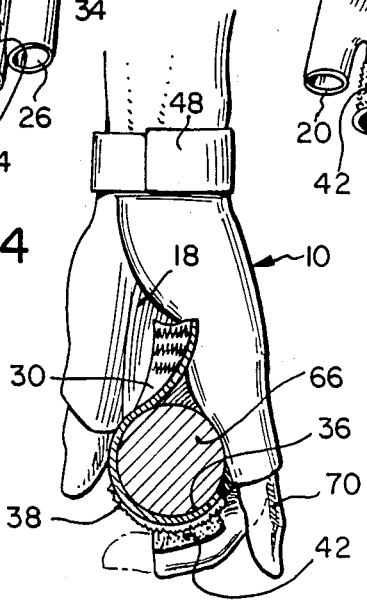
FIG. 4 is a side view of the glove of FIG. 1, shown worn by a user and attached to a barbell bar in section.
Figure 5:
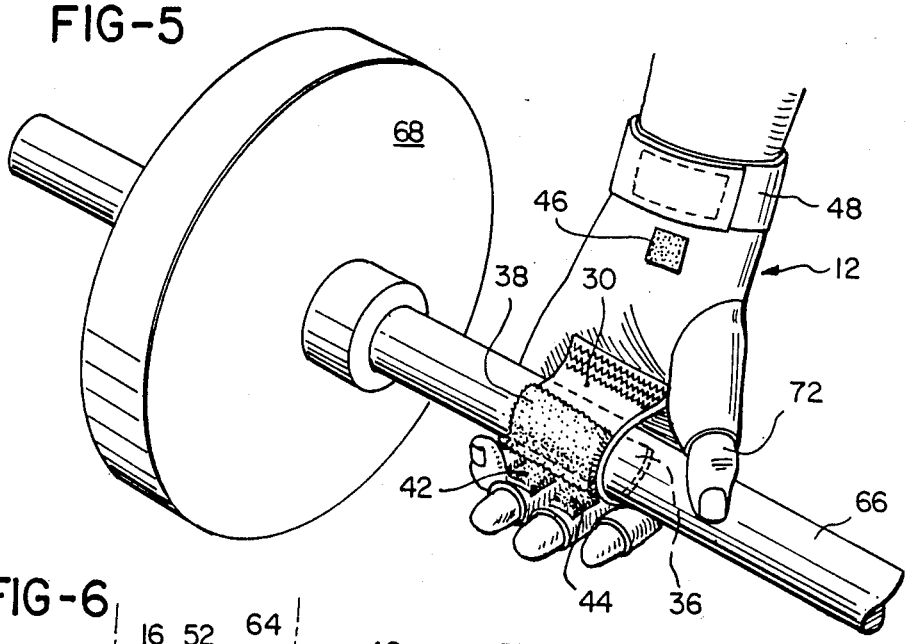
FIG. 5 is a perspective view of the glove of FIG. 2, shown engaging a barbell bar.

The operation of the gloves 10, 12 is shown in FIGS. 1, 4, and 5 with reference is performing a dead lift, in which a bar is lifted vertically from the floor. To perform a dead lift, the user first inserts his hands into the gloves as shown in FIGS. 4 and 5 for the right and left hand gloves 10, 12, respectively. The user then fastens the wrist straps 48 about his wrists such that the straps are snug but not so tight as to restrict blood circulation into the hands. Next, the user grasps the bar 66 and curls the palm straps outwardly away from the palm portions 18 of the gloves 10, 12, around the bar, and the free ends 36 are tucked beneath the bar so that the patches 38 of loop material overlap the patches 42, 44 of hook material on the stub fingers 22, 24, respectively. This occurs when the stub fingers 22, 24 are curled about the bar 66, best shown in FIG. 4, so that the overlapping patches 38, 42, 44 are directly beneath the bar 66.

As the bar is lifted, the downward force resulting from the weight of the bar and the plates 68 supported by the bar acts to compress the free end 36 of the palm strap 30 against the stub fingers 22, 24, thereby insuring that the hook and loop connection does not slide. Since a large portion of the the periphery of the bar 66 is enclosed by the palm strap 30, a relatively large portion of the weight of the bar 66 is borne by the strap, which transfers it to the palm portion 18 of the gloves 10, 12. This weight is applied to the bones of the hands 70, 72 of the user, as well as the user's wrists. Consequently, the force exerted on the fingers of the user is reduced.

To release the bar 66 from the straps 30, all that is needed is for the user to relax his grasp of the bar by rotating or uncurling his fingers outwardly away from his thumb. This causes the hook and loop patches 38, 42, 44 to disengage, allowing the strap 30 to free itself from the overlapping relationship with the stub fingers 22, 24.

When it is desired not to use the palm strap 30, it may be secured out of the way as shown in FIG. 3. This is accomplished by folding the palm strap 30 toward the wrist opening 16 so that the patch 38 of loop material engages the patch 46 of hook material on the palm portion 18.

Figure 6:
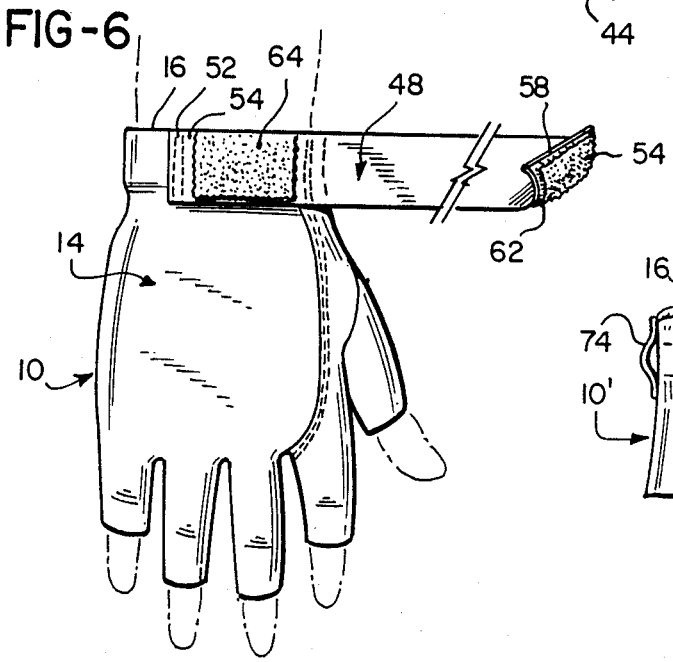
FIG. 6 is a back view of the glove of FIG. 1, in which the hand of a user is shown, in phantom, inserted in the glove.
Figure 7:
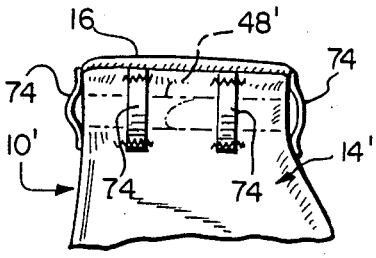
FIG. 7 is a detail showing an alternate embodiment of the invention.

An alternative embodiment of the invention is shown in FIG. 7. In this embodiment, the strap 48 (shown in FIG. 6) is not present. Instead, the glove body 14' is fitted with a plurality of loops 74 which are stitched to the glove body at their upper and lower ends. This allows a separate wrist strap 48' to be used in combination with the glove 10', simply by threading it through the loops 74.

While the foregoing explanation is directed to performing a dead lift, the sports glove of the present invention can be used to perform other lifts as well. For example, the sports glove can be useful in performing a bench press with thumbless grip, standing French curls, standing wrist curls, bent rowing, long pulley rowing, pull downs, clean and jerk (Olympic lift), and heavy bar shrugs. While the forms of apparatus herein described constitute preferred embodiments of this invention, it is to be understood that the invention is not limited to these precise forms of apparatus, and that changes may be made therein without departing from the scope of the invention.

What is claimed is:

1. A sports glove comprising:

a glove body shaped to slip over a human hand and including a wrist opening and a palm side made of a flexible material and including a palm portion;

a flexible strap attached at one end thereof to said palm portion and having a free end; and means for releasably attaching said free end to said glove body at a location on said palm side such that said one lies between said wrist opening and said attaching means on said palm side, whereby said strap can be looped outwardly away from said palm portion and said wrist opening, around an implement to be grasped, and secured to said attaching means such that tensile force exerted by said bar on a hand of a user is borne partially by said strap and glove body.

2. The glove of claim 1 further comprising means for releasably attaching said free end to said palm portion at a position between said one end and said wrist opening.

3. The glove of claim 1 further comprising means for attaching a wrist strap to said body adjacent to said wrist opening.

4. The glove of claim 1 further comprising a releasable wrist strap attached to said body adjacent to said wrist opening.

5. The glove of claim 1 wherein said body includes means, opposite said wrist opening, for receiving individual fingers of a human hand therethrough; and said attaching means is positioned in said finger means.

6. The glove of claim 1 wherein said releasable attaching means comprises a patch of hook material and a patch of loop material, one of said patches being attached to said free end, and the other of said patches is attached to said glove body at said location.

7. The glove of claim 6 further comprising a second one of said other patches attached to said glove body between said wrist opening and said one end of said strap.

8. A sports glove comprising:

a glove body shaped to slip over a human hand and including a wrist opening and a palm side made of a flexible material and including a palm portion;

a flexible strap having a fixed end attached to said palm portion and a free end; and means positioned on said palm side for frictionally engaging said free end at a location on said palm side such that said fixed end lies between said wrist opening and said engaging means on said palm side, whereby said strap can be looped outwardly away from said palm portion and said wrist opening, around a sports implement to be lifted, and placed in overlapping relation to said engaging means such that tensile force exerted by said implement on a hand of user urges said free end against said engaging means, whereby said force is born partially by said strap and glove body.

9. A sports glove comprising:

a glove body shaped to slip over a human hand and including a wrist opening, a plurality of open ended stub fingers, and a palm side having a palm portion made of a flexible material;

a flexible strap attached to one end thereof to said palm portion and having a free end;

a patch of hook material and a patch of loop material, one of said patches being attached to said free end and the other of said patches being attached to at least one of said stub fingers on the palm side of said glove body, whereby said strap can be looped outwardly away from said palm portion and said wrist opening, around a sports implement to be grasped, and said free end positioned to overlap said palm portion such that said patches of hook and loop material engage each other, whereby a tensile force exerted by said implement on a hand of a user is applied to said free end to secure said patches together, so that said force of said implement is borne partially by said strap and glove body; and a wrist strap attached to and including said glove adjacent to said wrist opening.

* * * * *